US011761143B2

(12) United States Patent
Limpaecher et al.

(10) Patent No.: US 11,761,143 B2
(45) Date of Patent: Sep. 19, 2023

(54) WATER REACTIVE MATERIALS FOR DRYING ARTICLES

(71) Applicants: Massachusetts Institute of Technology, Cambridge, MA (US); United States Marine Corps, Washington, DC (US)

(72) Inventors: Erik Limpaecher, Concord, MA (US); Jacob Clayton, Chicago, IL (US); Douglas Baker, Swansboro, NC (US); William Hornsby, Fort Belvoir, VA (US)

(73) Assignees: Massachusetts Institute of Technology, Cambridge, MA (US); United States Marine Corps, Washington, DC (US)

( * ) Notice: Subject to any disclaimer, the term of this patent is extended or adjusted under 35 U.S.C. 154(b) by 114 days.

(21) Appl. No.: 17/334,017

(22) Filed: May 28, 2021

(65) Prior Publication Data

US 2022/0380969 A1 Dec. 1, 2022
US 2023/0183915 A2 Jun. 15, 2023

(51) Int. Cl.
*D06F 60/00* (2009.01)
*A47L 23/20* (2006.01)

(52) U.S. Cl.
CPC ..... *D06F 60/00* (2013.01); *A47L 23/20* (2013.01)

(58) Field of Classification Search
CPC ..... D06F 60/00; A47L 23/20
USPC ..... 34/353
See application file for complete search history.

(56) References Cited

U.S. PATENT DOCUMENTS 2,565,028 A * 8/1951 Keithley, Jr. ..... A43B 17/102 36/1
6,378,224 B1 * 4/2002 Qualkinbush ..... A61L 9/042 34/104
9,585,498 B1 * 3/2017 Borden ..... D06F 59/02
2011/0061257 A1 * 3/2011 Balsillie ..... A47L 23/20 34/95.2
2014/0008374 A1 * 1/2014 Lubart ..... B65D 81/3823 220/592.2
2016/0355918 A1 12/2016 Slocum
2017/0023299 A1 * 1/2017 Leung ..... A47L 23/20
2019/0289952 A1 * 9/2019 Gonzalez ..... A43B 5/00

* cited by examiner

*Primary Examiner* — John P McCormack
(74) *Attorney, Agent, or Firm* — Wolf, Greenfield & Sacks, P.C.

(57) ABSTRACT

Devices and methods related to drying absorbent articles with water reactive materials are generally described.

23 Claims, 4 Drawing Sheets

WATER REACTIVE MATERIALS FOR DRYING ARTICLES

GOVERNMENT SPONSORSHIP

This invention was made with Government support under FA8702-15-D-0001 awarded by the U.S. Air Force. The Government has certain rights in the invention.

TECHNICAL FIELD

Devices and methods related to drying absorbent articles with water reactive materials are generally described.

BACKGROUND

Foot care remains a common concern among individuals that may be present in the field for long periods of time where they may be exposed to wet conditions for prolonged periods. Common footwear drying techniques, such as air drying or using absorbents, require 12 to 48 hours to fully dry the footwear. Other solutions, such as electrically powered fans or blowers, require access to electricity and are ineffective in cold or humid environments. Alternatively, exposing the boots directly to a heat source risks damaging the footwear's materials.

SUMMARY

Devices and methods related to drying absorbent articles with water reactive materials are generally described. The subject matter of the present disclosure involves, in some cases, interrelated products, alternative solutions to a particular problem, and/or a plurality of different uses of one or more systems and/or articles.

According to certain embodiments, a method of draying an absorbent article is described. In some embodiments, the method comprises exposing the absorbent article to a water reactive material, and allowing the water reactive material to react with water, wherein the water reactive material comprises aluminum.

According to some embodiments, an apparatus for drying an absorbent article wearable garment is described. In certain embodiments, the apparatus comprises an insert comprising a water reactive material, wherein the insert is configured to expose at least a portion of the wearable garment to the water reactive material when inserted into the wearable garment, wherein the water reactive material comprises aluminum.

Other advantages and novel features of the present disclosure will become apparent from the following detailed description of various non-limiting embodiments of the disclosure when considered in conjunction with the accompanying figures. In cases where the present specification and a document incorporated by reference include conflicting and/or inconsistent disclosure, the present specification shall control.

BRIEF DESCRIPTION OF THE DRAWINGS

Non-limiting embodiments of the present disclosure will be described by way of example with reference to the accompanying figures, which are schematic and are not intended to be drawn to scale. In the figures, each identical or nearly identical component illustrated is typically represented by a single numeral. For purposes of clarity, not every component is labeled in every figure, nor is every component of each embodiment of the disclosure shown where illustration is not necessary to allow those of ordinary skill in the art to understand the disclosure. In the figures.

DETAILED DESCRIPTION

Figure 1:
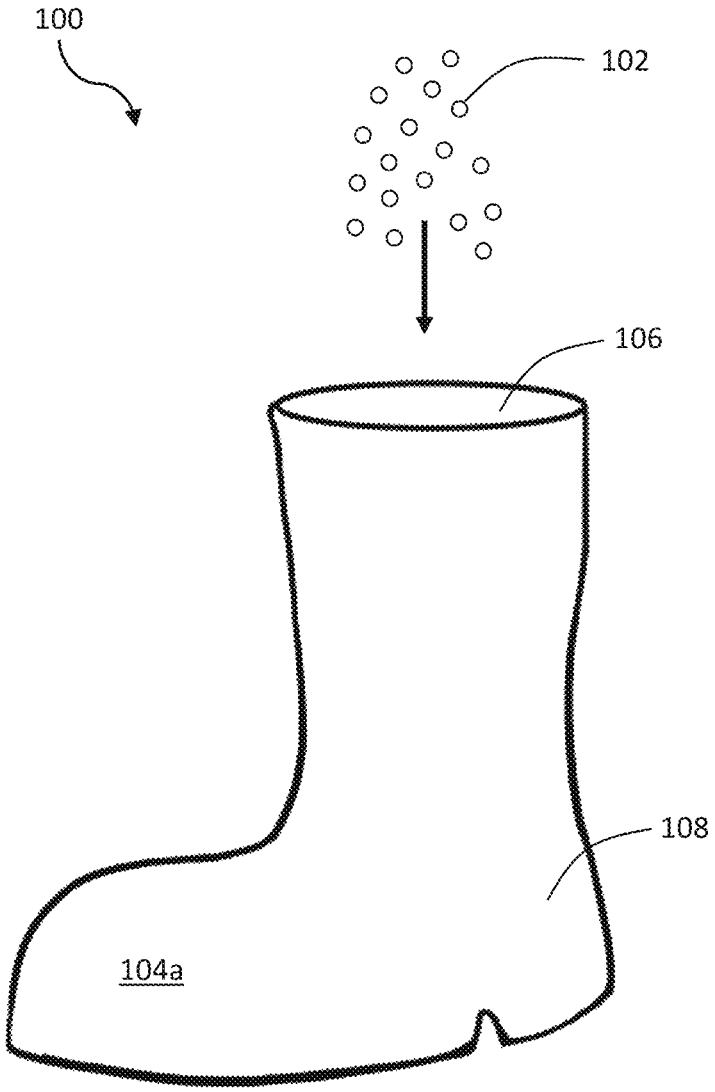
FIG. 1 shows, according to certain embodiments, a schematic diagram depicting an absorbent article being exposed to a water reactive material.

The Inventors have realized and appreciated that water reactive materials may be used to dry absorbent articles more quickly and efficiently than conventional drying methods. Conventional drying methods utilize air drying techniques or ineffective absorbents (e.g., rice, newspaper). Such methods are extremely inefficient, requiring extended periods of time (e.g., 12 to 48 hours) to fully dry an article that has absorbed water. Furthermore, electrically powered methods, such as fans, blowers, or heaters, require access to electricity. Such traditional drying methods are not practical when an article absorbs water in the field. Thus, individuals may be required to wear water-logged clothing articles in the field (e.g., boots, socks, and the like) due to the inability to quickly and easily try these articles. Accordingly, the Inventors have recognized that drying techniques that can be easily employed in the field to dry a wet article quicker than conventional techniques may be desirable.

In view of the above, the Inventors have recognized the benefits associated with devices and methods related to drying absorbent articles utilizing water reactive materials to react with the water absorbed by these articles. An article that has absorbed water (e.g., a wearable garment), for example, may be exposed to a water reactive material (e.g., aluminum) such that the water reactive material reacts with the absorbed water and dries the article, for example, within minutes as the reaction proceeds. The reaction between water and the water reactive material may also be exothermic, therefore producing heat that may further aid with evaporating any residual unreacted water not consumed by the reaction.

In certain embodiments, a method of drying an absorbent article is described, the method comprising exposing the absorbent article to a water reactive material and allowing the water reactive material to react with water. The absorbent article may be exposed to the water reactive material using any of a variety of suitable techniques that are described herein in greater detail. According to certain embodiments, for example, the water reactive material may be applied to an exterior and/or interior of the water absorbent article. This may either be through direct contact of the water reactive material with the absorbent article and/or indirectly through an intermediate material the water may pass through. Additionally, in some other embodiments, the absorbent article may be exposed to the water reactive material by placing the absorbent article in a container the water reactive material may be disposed within.

According to some embodiments, exposing the absorbent article to the water reactive material comprises inserting an insert (e.g., a liner) comprising the water reactive material disposed within an internal volume of the absorbent article.

The insert may be configured, in certain embodiments, such that the water reactive material is in direct contact with one or more water-logged interior portions of the absorbent article. In some embodiments, for example, the insert may include a mesh or other material with openings that are sufficiently large to permit the water reactive material to make contact with the absorbent article through the openings while still retaining the water reactive material in the insert. In certain embodiments, the insert may be configured to wick water across and/or through the insert such that water comes into contact with and reacts with the water reactive material.

In certain embodiments the water reactive material may comprise aluminum or an alloy thereof. Without wishing to be bound by theory, water and aluminum react to produce hydrogen gas according to either of the following exothermic reactions shown in reactions (1) and (2):

$$2Al+4H_2O \rightarrow 3H_2+2AlO(OH)+Q1 \quad (1)$$

$$2Al+6H_2O \rightarrow 3H_2+2Al(OH)_3+Q2 \quad (2)$$

where Q1 and/or Q2 is between 840 kJ to 880 kJ of heat, depending on the extent of the reaction. It may be advantageous to use aluminum as the water reactive material, in some embodiments. For example, as would be understood by a person of ordinary skill in the art, the product hydrogen gas is buoyant in air and will be easily separated from the absorbent article. In certain embodiments, the products AlO(OH) (boehmite) and/or $2Al(OH)_3$ (bayerite) function as desiccant that can, for example, absorb residual moisture within the absorbent article. Furthermore, the heat produced (i.e., Q1 and Q2 in reactions (1) and (2), respectively) may mitigate or otherwise kill bacteria and/or fungus living in and/or on the absorbent article as a result of the moist environment caused by the presence of water.

Other metals may also be employed as the water reactive material, depending on the particular embodiment. For example, non-limiting examples of water reactive material that may be used include aluminum, lithium, sodium, magnesium, zinc, boron, beryllium, alloys thereof, and/or mixtures thereof.

The water reactive material, in some embodiments, comprises an activating composition that is permeated into the grain boundaries and/or subgrain boundaries of the reactant (e.g. aluminum) to facilitate its reaction with water. For example, a reactant may include aluminum combined with gallium and/or indium. In some instances, the activating composition may be an eutectic, or close to eutectic composition, including for example an eutectic composition of gallium and indium. In one such embodiment, the activating composition may comprise gallium and indium where the portion of the activating composition may have a composition of about 70 wt. % to 80 wt. % gallium and 20 wt. % to 30 wt % indium, though other weight percentages are also possible. Without wishing to be bound by theory, gallium and/or indium may permeate through one or more grain boundaries and/or subgrain boundaries of the reactant (e.g., aluminum).

In certain embodiments, the activating composition may be incorporated into an alloy with the reactant. A metal alloy may comprise any activating composition in any of a variety of suitable amounts. In some embodiments, for example, the metal alloy comprises greater than or equal to 0.1 wt. % of the activating composition, greater than or equal to 1 wt. %, greater than or equal to 5 wt. %, greater than or equal to 15 wt. %, greater than or equal to 30 wt. %, or greater than or equal to 45 wt. % of the activating composition based on the total weight of the metal alloy. In certain embodiments, the metal alloy comprises less than or equal to 50 wt. %, less than or equal to 40 wt. %, less than or equal to 30 wt. %, less than or equal to 20 wt. %, less than or equal to 10 wt. %, less than or equal to 5 wt. %, or less than or equal to 1 wt. % of the activating composition, based on the total weight of the metal alloy. Combinations of the above recited ranges are also possible (e.g., the metal alloy comprises greater than or equal to 0.1 wt. % and less than or equal to 50 wt. % of the activating composition based on the total weight of the metal alloy, the metal alloy comprises greater than or equal to 1 wt. % and less than or equal to 10 wt. % of the activating composition based on the total weight of metal alloy). Other ranges are also possible.

The water reactive material may comprise particles (e.g., nanoparticles, microparticles, etc.). In some embodiments, the particles may be regularly shaped, such as spherical, or may be irregularly shaped chunks. The size of the water reactive particles may be uniform or varied. Alternatively, the water reactive particles may be provided in a more continuous form, such as a powder with any appropriate size distribution for a desired application.

The water reactive particles may have any of a variety of suitable maximum characteristic dimensions (e.g., diameter, length, height, width). In some embodiments, for example, the water reactive particles have an average maximum characteristic dimension (e.g., maximum cross-sectional dimension) less than or equal to 10 millimeters, less than or equal to 9 millimeters, less than or equal to 7 millimeters, less than 5 millimeters, less than or equal to 3 millimeters, less than or equal to 1 millimeter, less than or equal to 900 micrometers, less than or equal to 700 micrometers, less than or equal to 500 micrometers, less than or equal to 300 micrometers, less than or equal to 100 micrometers, less than or equal to 90 micrometers, less than or equal to 70 micrometers, less than or equal to 50 micrometers, less than or equal to 30 micrometers, less than or equal to 10 micrometers, or less. In certain embodiments, the water reactive particles have an average maximum characteristic dimension greater than or equal to 1 micrometer, greater than or equal to 10 micrometers, greater than or equal to 30 micrometers, greater than or equal to 50 micrometers, greater than or equal to 70 micrometers, greater than or equal to 90 micrometers, greater than or equal to 100 micrometers, greater than or equal to 300 micrometers, greater than or equal to 500 micrometers, greater than or equal to 700 micrometers, greater than or equal to 900 micrometers, greater than or equal to 1 millimeter, greater than or equal to 3 millimeters, greater than or equal to 5 millimeters, greater than or equal to 7 millimeters, greater than or equal to 9 millimeters, or greater. Combinations of the above recited ranges are also possible (e.g., the water reactive particles have an average maximum characteristic dimension less than or equal to 10 millimeters and greater than or equal to 1 micrometer, the water reactive particles have an average maximum characteristic dimension between less than or equal to 1 millimeter and greater than or equal to 500 micrometers). Other ranges are also possible.

According to certain embodiments, the absorbent article may be exposed to an excess of water reactive materials relative to the amount of water absorbed by the article. Advantageously, utilizing an excess of water reactive materials may ensure that there is sufficient reactive material to react with the absorbed water and may aid in increasing the amount of water the water reactive materials react with and/or evaporate off due to heat produced from the reaction.

In certain embodiments, any unreacted water reactive material may be collected and used for a subsequent drying event In some embodiments, the molar ratio of the water reactive material relative to absorbed water is greater than or equal to 1:1, greater than or equal to 1.5:1, greater than or equal to 2:1, greater than or equal to 2.5:1, greater than or equal to 3:1, greater than or equal to 3.5:1, greater than or equal to 4:1, greater than or equal to 4.5:1, or greater. In some embodiments, the molar ratio of the water reactive material to absorbed water is less than or equal to 5:1, less than or equal to 4.5:1, less than or equal to 4:1, less than or equal to 3.5:1, less than or equal to 3:1, less than or equal to 2.5:1, less than or equal to 2:1. Less than or equal to 1.5:1, or less. Combinations of the above recited ranges are also possible (e.g., the molar ratio of the water reactive material relative to absorbed water is between greater than or equal to 1:1 and less than or equal to 5:1, the molar ratio of the water reactive material relative to absorbed water is between greater than or equal to 2:1 and less than or equal to 4:1). Other ranges are also possible.

In certain embodiments, a composition including a water reactive material may further comprise a desiccant. Any of a variety of suitable desiccants may be utilized. For example, in certain embodiments, the desiccant comprises talcum powder, silica, activated charcoal, calcium sulfate, calcium chloride, and/or molecular sieves (e.g., zeolites, metal-organic frameworks).

The composition including the water reactive material may comprise any of a variety of suitable amounts of a desiccant. In certain embodiments, for example, the composition may comprise a desiccant in an amount greater than or equal to 10 wt. %, greater than or equal to 20 wt. %, greater than or equal to 30 wt. %, greater than or equal to 40 wt. %, greater than or equal to 50 wt. %, greater than or equal to 60 wt. %, greater than or equal to 70 wt. %, or greater, based on the total weight of the water reactive material. In certain embodiments, the composition comprises a desiccant in an amount less than or equal to 80 wt. %, less than or equal to 70 wt. %, less than or equal to 60 wt. %, less than or equal to 50 wt. %, less than or equal to 40 wt. %, less than or equal to 30 wt. %, less than or equal to 20 wt. %, or less, based on the total weight of the water reactive material. Combinations of the above recited ranges are also possible (e.g., the composition comprises a desiccant in an amount greater than or equal to 10 wt. % and less than or equal to 80 wt. % based on the total weight of the water reactive material, the water reactive material comprises a desiccant in an amount greater than or equal to 40 wt. % and less than or equal to 60 wt. % based on the total weight of the water reactive material). Other ranges are also possible.

When used to dry water from an absorbent article containing absorbed water, the water reactive materials disclosed herein may cause a reduction in the water weight of the absorbent article after allowing the water reactive material to react with water. For example, in certain embodiments, the water reactive material causes a reduction in the water weight of the absorbent article of greater than or equal to a 10%, greater than or equal to 20%, greater than or equal to 30%, greater than or equal to 40%, greater than or equal to 50%, greater than or equal to 60%, greater than or equal to 70%, greater than or equal to 80%, or greater. In some embodiments, the water reactive material causes a reduction in the water weight of the absorbent article of less than or equal to 90%, less than or equal to 80%, less than or equal to 70%, less than or equal to 60%, less than or equal to 50%, less than or equal to 40%, less than or equal to 30%, less than or equal to 20%, or less. Combinations of the above recited ranges are also possible (e.g., the water reactive material causes a reduction in the water weight of water weight of the absorbent article of greater than or equal to a 10% and less than or equal to 90%, the water reactive material causes a reduction in the water weight of water weight of the absorbent article of greater than or equal to a 40% and less than or equal to 60%). Other ranges are also possible.

The materials and devices disclosed herein may be used to dry any of a variety of articles susceptible to absorbing water. In some embodiments, for example, the absorbent article comprises a household item (e.g., a towel, a blanket, a pillow, a rug, a sponge, and the like), a universal absorbent (e.g., an absorbent mat, pad, and the like), exercise equipment (e.g., jogging and/or hiking equipment), a wearable garment, and/or any other absorbent article that a user may wish to dry. With regards to wearable garments, a wearable garment may comprise footwear (e.g. boots, shoes, skates, and the like), gloves, headwear (e.g., hats, helmets, and the like), underwear, and/or outerwear (e.g., shirts, pants, and the like), and/or any other garment that may be worn by an individual.

Turning to the figures, specific non-limiting embodiments are described in further detail. It should be understood that the various systems, components, features, and methods described relative to these embodiments may be used either individually and/or in any desired combination as the disclosure is not limited to only the specific embodiments described herein.

FIG. 1 shows, according to certain embodiments, a schematic diagram depicting absorbent article 104*a* being exposed to water reactive material 102. In certain embodiments, exposing absorbent article 104*a* to water reactive material 102 comprises applying water reactive material 102 to at least a portion of interior 106 and/or exterior 108 of absorbent article 104*a*. Water reactive material 102 may be applied, poured, or otherwise dispersed into interior 106 and/or onto exterior 108 of absorbent article 104*a*, in some embodiments such that the water reactive material comes into either direct, or indirect, contact with a portion of the article including absorbed water.

In certain embodiments, one or more packets and/or pouches that comprise the water reactive material may be utilized to expose the absorbent article to the water reactive material. In some such embodiments, for example, when the article absorbs water, the user may tear or otherwise break one or more packets and/or pouches, followed by exposing the absorbent article to the water reactive material contained within the one or more packets and/or pouches (e.g., by pouring the water reactive material from the packets and/or pouches into and/or onto the absorbent article). Such packets and/or pouches may be single use or reusable, in some embodiments.

Figure 2:
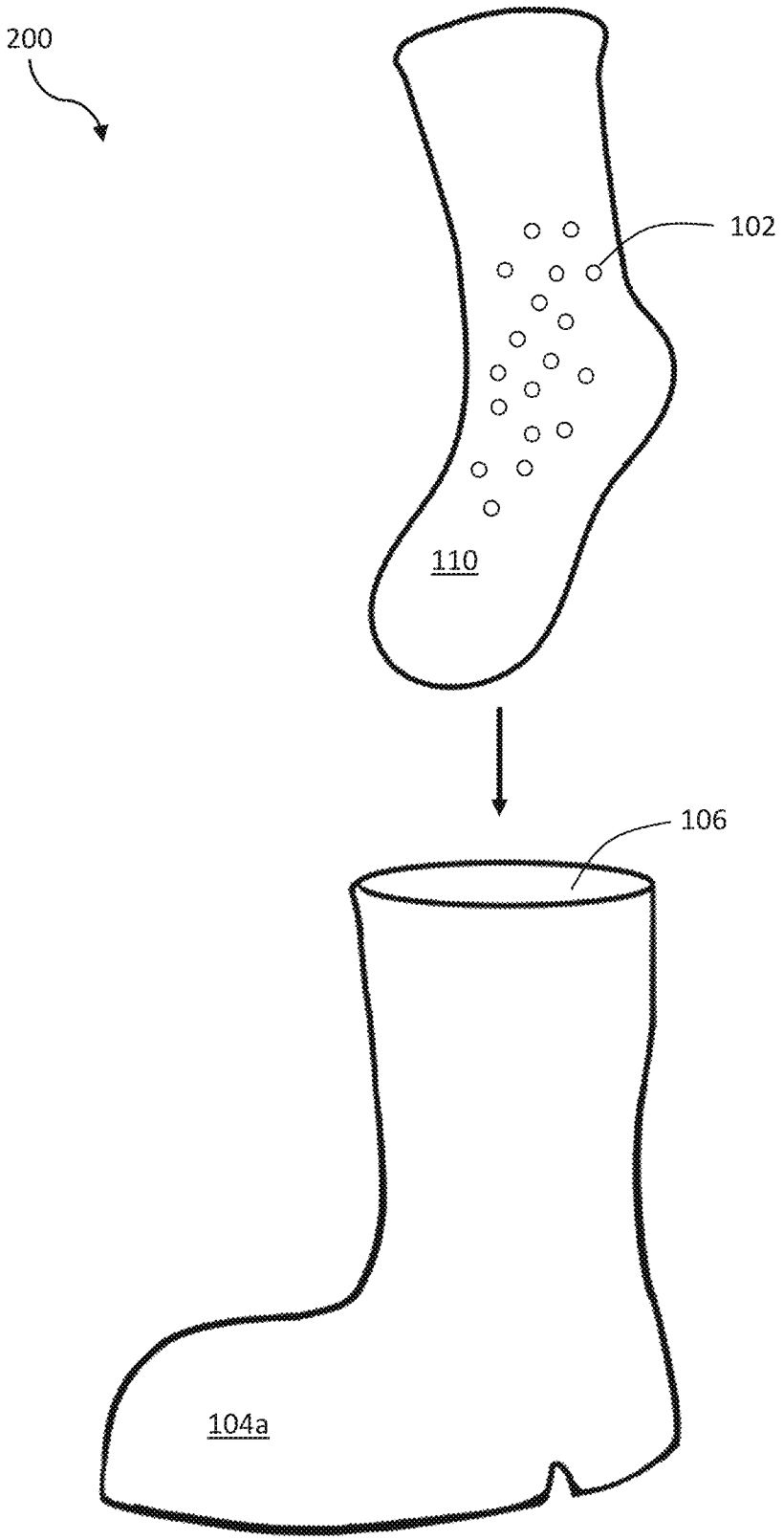
FIG. 2 shows, according to certain embodiments, a schematic diagram depicting an insert comprising a water reactive material being inserted into an absorbent article.

As mentioned herein, an insert comprising a water reactive material may be utilized to dry an absorbent article. For example, in certain embodiments, exposing the adsorbent material comprises inserting an insert comprising the water reactive material into the absorbent material such that the water reactive material is exposed to at least a portion of an interior of the wearable garment. FIG. 2 shows, according to some embodiments, a schematic diagram depicting insert 110 comprising water reactive material 102 being inserted into absorbent article 104*a*. In some embodiments, as insert 110 comprising water reactive material 102 is inserted into absorbent article 104*a*, water reactive material 102 is exposed to and reacts with water absorbed by absorbent article 104*a*.

Although a boot is exemplified as absorbent article 104*a* in FIGS. 1-2, other absorbent articles may be envisioned, such as any of the wearable articles described herein, as the disclosure is not meant to be limiting in this regard.

According to certain embodiments, insert 110 is configured to directly contact at least a portion of interior 106 of absorbent article 104*a*. Insert 110 may, in some embodiments, have substantially the same shape as absorbent article 104*a*. For example, in some embodiments, insert 110 comprises a liner (e.g., a boot liner). As insert 110 (e.g., liner) is inserted into absorbent article 104*a*, insert 110 may directly contact at least a portion of interior 106 of absorbent article 104*a*, such that water reactive material 102 is exposed to and reacts with water absorbed by absorbent article 104*a*. For example, insert 110 (e.g., liner) may, in certain embodiments, conform to the shape of the interior volume of absorbent article 104*a*, therefore advantageously improving the surface area of insert 110 that directly contacts interior 106 of absorbent article 104*a*.

The insert may comprise the water reactive material in any of a variety of suitable locations. For example, in some embodiments, insert 110 comprises water reactive material 102 within one or more pores of the insert. In certain embodiments, an exterior and/or interior of insert 110 may be at least partially coated with water reactive material 102. Insert 110 may, in some embodiments, define a space with an interior volume that water active material 102 may be disposed within.

In some embodiments, the insert is configured to wick water across and/or through the insert. As used herein, the term "wick" is given its ordinary meaning in the art and generally refers to the ability to absorb or draw off liquid by capillary action. Insert 110 may comprise a material, in some embodiments, configured to move water and/or moisture across and/or through insert 110, thus exposing water to water reactive material 102, which, as stated above, may be present within one or more pores of insert 110, coated on an interior and/or exterior of insert 110, and/or disposed within an interior volume of insert 110.

The water reactive material may be applied to the insert using any of a variety of techniques. In some embodiments, for example, the insert (e.g., liner) has an open volume in which the water reactive material can be poured into. In certain embodiments, the insert may be exposed to the water reactive material (e.g., by dipping, rolling, spraying, and the like) such that the water reactive material is contained within one or more pores of the insert. For example, the insert may comprise a material with a plurality of pores that are sized sufficiently small to contain the water reactive material therewithin (e.g., a plurality of pores having an average maximum characteristic dimension greater than or equal to 1 micrometer and less than or equal to 10 millimeters). In certain embodiments, an exterior and/or interior of the insert may be coated with the water reactive material using techniques known to a person of ordinary skill in the art (e.g., dipping, rolling, spraying, and the like).

The insert may comprise any of a variety of suitable materials. For example, the insert may comprise a material that can withstand elevated temperatures, such as greater than or equal to 100° C. Such temperatures are necessary in order to ensure that residual moisture and/or water absorbed by the absorbent article is evaporated off (e.g., as steam). The insert may, in certain embodiments, be at least partially rigid such that it substantially retains its shape when inserted into the absorbent article. In some embodiments, the insert is at least partially flexible such that it substantially conforms to the shape of the absorbed article when inserted, as described above.

Figure 4:
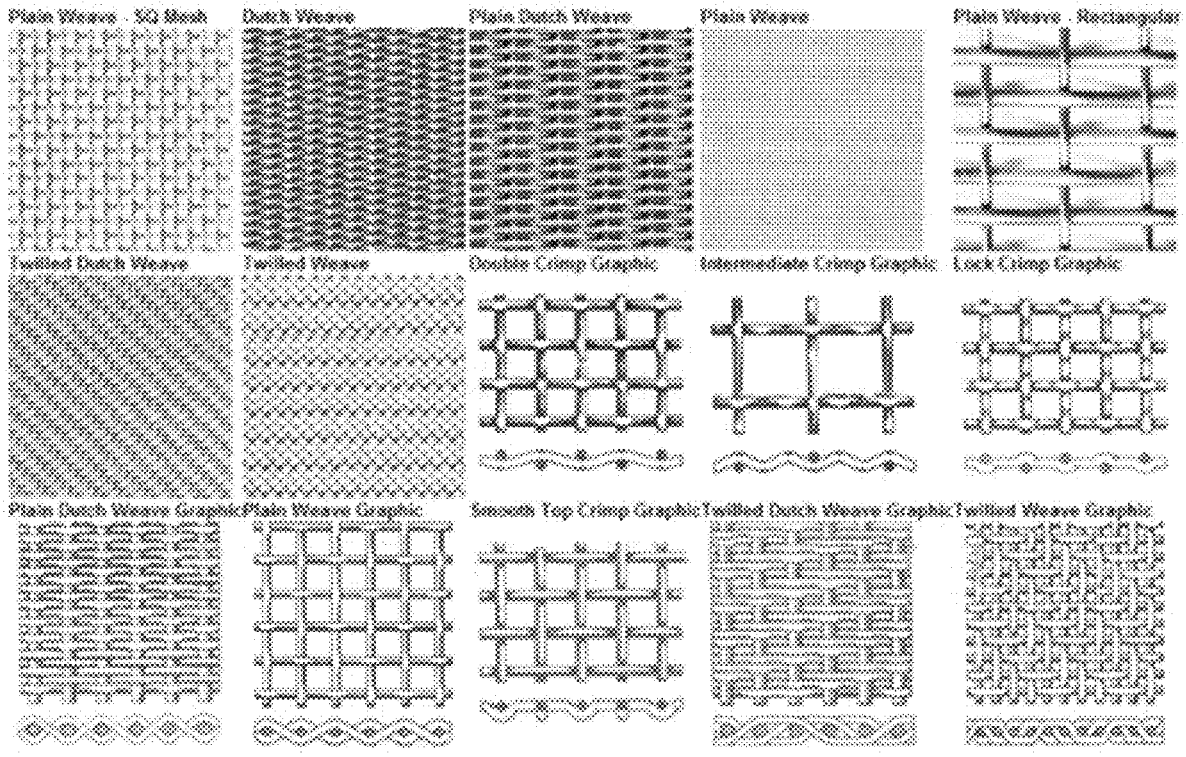
FIG. 4 shows, according to certain embodiments, a schematic diagram of various wire mesh patterns.

In some embodiments, for example, the insert comprises a wire mesh and/or tube (e.g., wire fabric, wire cloth). FIG. 4 shows, according to certain embodiments, a schematic diagram of various wire mesh patterns, any of which may be employed as the wire mesh of the insert. In certain embodiments, the insert comprises nylon (e.g., nylon 66, nylon 6, nylon 510, nylon 1,6), cheesecloth, a plastic mesh and/or tube (e.g., polypropylene, nylon, polyethylene, polyester, and the like), and/or filter paper (e.g., cellulose).

In some embodiments, the insert may be single use. For example, in certain embodiments, the insert may be discarded after being used to dry an absorbent article. In other embodiments, the insert may be reusable. In some such embodiments, the insert may be removed from the absorbent article after being used to dry it, and any by-products (e.g., bayerite, boehmite) may be removed from the insert, which is then refilled with the water reactive material.

Figure 3:
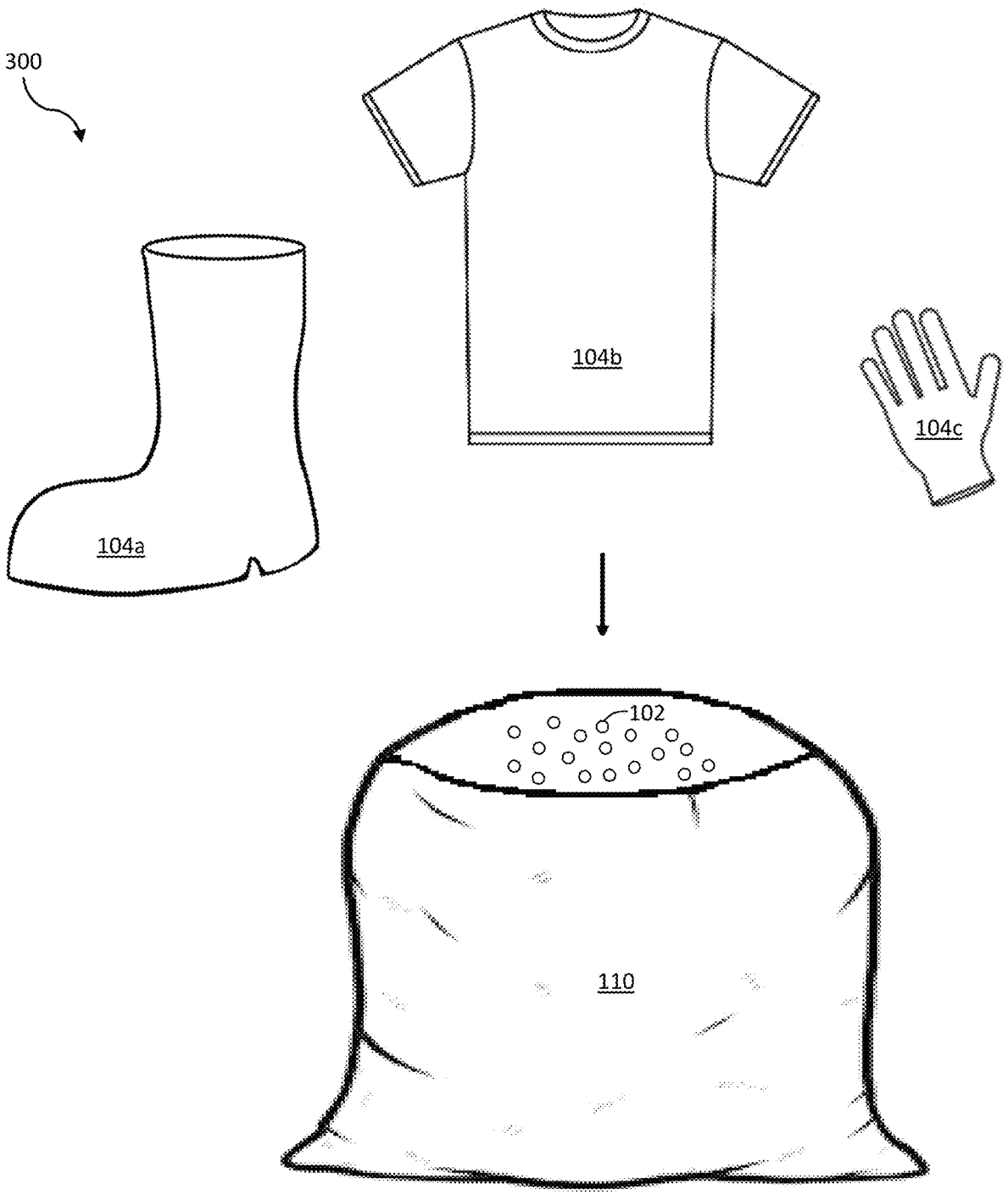
FIG. 3 shows, according to certain embodiments, a schematic diagram depicting a plurality of absorbent articles being exposed to a water reactive material.

According to certain embodiments, a container comprising a water reactive material may be utilized to dry the absorbent article. FIG. 3 shows, according to certain embodiments, a schematic diagram depicting a plurality of absorbent articles being exposed to a water reactive material. Referring to FIG. 3, absorbent articles 104*a*, 104*b*, and/or 104*c* may be placed into container 110 comprising water reactive material 102. After placing absorbent articles 104*a-c* into container 110, container 110 may be substantially sealed or closed, in some embodiments, followed by shaking and/or mixing container 110 to ensure exposure of absorbent articles 104*a-c* to water reactive material 102.

Container 110 may be any of a variety of suitable containers. In some embodiments, container 110 may be at least partially porous. Advantageously, a container that is at least partially porous allows any gaseous products produced from the reaction between the water reactive material and the absorbed water (e.g., hydrogen gas, steam) to easily escape the container. In certain embodiments, the container may comprise a material that is configured to withstand elevated temperatures, such as greater than or equal to 100° C., and/or exposure to water.

In certain embodiments, container 110 may be an at least partially flexible container, such as a bag (e.g., laundry bag, garment bag), a backpack, and the like. In certain embodiments, container 110 may at least partially rigid (e.g., luggage, a shipping container, a waste receptable, and the like.

The embodiments described herein may be embodied as a method, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

Further, some actions are described as taken by a "user." It should be appreciated that a "user" need not be a single individual, and that in some embodiments, actions attributable to a "user" may be performed by a team of individuals and/or an individual in combination with computer-assisted tools or other mechanisms.

While several embodiments of the present disclosure have been described and illustrated herein, those of ordinary skill in the art will readily envision a variety of other means and/or structures for performing the functions and/or obtaining the results and/or one or more of the advantages described herein, and each of such variations and/or modifications is deemed to be within the scope of the present disclosure. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings of the present disclosure is/are used. Those skilled in the art will recognize, or be able to ascertain using no more than routine experimentation, many equivalents to the specific embodiments of the disclosure described herein. It is, therefore, to be understood that the foregoing embodiments are presented by way of example only and that, within the scope of the appended claims and equivalents thereto, the disclosure may be practiced otherwise than as specifically described and claimed. The present disclosure is directed to each individual feature, system, article, material, and/or method described herein. In addition, any combination of two or more such features, systems, articles, materials, and/or methods, if such features, systems, articles, materials, and/or methods are not mutually inconsistent, is included within the scope of the present disclosure.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Other elements may optionally be present other than the elements specifically identified by the "and/or" clause, whether related or unrelated to those elements specifically identified unless clearly indicated to the contrary. Thus, as a non-limiting example, a reference to "A and/or B," when used in conjunction with open-ended language such as "comprising" can refer, in one embodiment, to A without B (optionally including elements other than B); in another embodiment, to B without A (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

In the claims, as well as in the specification above, all transitional phrases such as "comprising," "including," "carrying," "having," "containing," "involving," "holding," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

What is claimed is:

1. A method of drying an absorbent article, the method comprising:

exposing the absorbent article to a water reactive material; and allowing the water reactive material to react with water, wherein the water reactive material comprises aluminum and an activating composition comprising gallium.

2. The method of claim 1, wherein exposing comprises applying the water reactive material to at least a portion of an interior of the absorbent article.

3. The method of claim 1, wherein exposing comprises inserting an insert comprising the water reactive material into the absorbent article such that the water reactive material is exposed to at least a portion of an interior of the absorbent article.

4. The method of claim 3, wherein at least a portion of the insert directly contacts the interior of the absorbent article.

5. The method of claim 3, wherein the insert comprises a material configured to wick water across and/or through the insert.

6. The method of claim 3, wherein the insert comprises a liner.

7. The method of claim 3, wherein the insert comprises a wire mesh.

8. The method of claim 1, wherein the aluminum comprises aluminum particles having a maximum cross-sectional dimension less than or equal to 7 mm.

9. The method of claim 1, wherein the water reactive material comprises a desiccant.

10. The method of claim 1, wherein the absorbent article comprises a wearable garment.

11. The method of claim 10, wherein the wearable garment comprises footwear.

12. The method of claim 10, wherein the wearable garment comprises gloves, headwear, underwear, and/or outerwear.

13. An apparatus for drying an absorbent article comprising:

an insert comprising a water reactive material, wherein the insert is configured to expose at least a portion of the absorbent article to the water reactive material when inserted into the absorbent article, wherein the water reactive material comprises aluminum and an activating composition comprising gallium.

14. The apparatus of claim 13, wherein the insert is configured to directly contact at least a portion of an interior of the absorbent article.

15. The apparatus of claim 13, wherein the insert is configured to wick water across and/or through the insert.

16. The apparatus of claim 13, wherein the insert comprises a liner.

17. The apparatus of claim 13, wherein the water reactive material is disposed inside of a volume formed by the insert.

18. The apparatus of claim 13, wherein the insert comprises at least one selected from a wire mesh and a material configured to wick water across and/or through the insert.

19. The apparatus of claim 13, wherein the aluminum comprises aluminum particles having a maximum cross-sectional dimension less than or equal to 7 mm.

20. The apparatus of claim 13, wherein the water reactive material comprises a desiccant.

21. The apparatus of claim 13, wherein the absorbent article comprises a wearable garment.

22. The apparatus of claim 21, wherein the wearable garment comprises footwear.

23. The apparatus of claim 21, wherein the wearable garment comprises gloves, headwear, underwear, and/or outerwear.

* * * * *